US010895263B2

(12) United States Patent
Hoss et al.

(10) Patent No.: US 10,895,263 B2
(45) Date of Patent: Jan. 19, 2021

(54) MULTIPART HOUSING OF A FAN

(71) Applicant: ebm-papst Mulfingen GmbH & Co. KG, Mulfingen (DE)

(72) Inventors: Sebastian Hoss, Bad Mergentheim (DE); Thomas Sauer, Bad Mergentheim (DE); Hartmut Messerschmidt, Ingelfingen (DE); Matthias Maschke, Kupferzell (DE); Alexander Lust, Obersulm-Affaltrach (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 319 days.

(21) Appl. No.: 15/552,037

(22) PCT Filed: Mar. 3, 2016

(86) PCT No.: PCT/EP2016/054579
§ 371 (c)(1),
(2) Date: Aug. 18, 2017

(87) PCT Pub. No.: WO2016/142276
PCT Pub. Date: Sep. 15, 2016

(65) Prior Publication Data

US 2018/0030985 A1 Feb. 1, 2018

(30) Foreign Application Priority Data

Mar. 10, 2015 (DE) ..... 10 2015 103 501

(51) Int. Cl.
*F04D 19/00* (2006.01)
*F04D 29/58* (2006.01)
(Continued)

(52) U.S. Cl.
CPC ..... *F04D 19/002* (2013.01); *F04D 29/522* (2013.01); *F04D 29/5853* (2013.01); *F04D 29/646* (2013.01); *F04D 29/703* (2013.01)

(58) Field of Classification Search
CPC combination set(s) only.
See application file for complete search history.

(56) References Cited

U.S. PATENT DOCUMENTS

2006/0286924 A1* 12/2006 Milana ..... F04D 25/0613 454/259
2011/0076152 A1 3/2011 Streng
(Continued)

FOREIGN PATENT DOCUMENTS

DE 202008002350 U1 * 6/2009 ..... C09D 1/02
DE 102012019419 A1 4/2014
(Continued)

OTHER PUBLICATIONS

Machine Translation of DE102012109544A1 PDF File Name: "DE102012109544A1_Machine_Translation.pdf" (Year: 2014).*
(Continued)

*Primary Examiner* — Lindsay M Low
*Assistant Examiner* — Ruben Picon-Feliciano
(74) *Attorney, Agent, or Firm* — Harness, Dickey & Pierce, P.L.C.

(57) ABSTRACT

The invention concerns a housing of a fan with an external covering, wherein the housing comprises a housing body to accommodate fan components, and a radial exterior face of the housing body is surrounded by the external covering in the circumferential direction over its full surface, so that a radial exterior surface of the housing is formed by an exterior surface of the external covering, and the external covering is detachably fastened to the housing body.

10 Claims, 2 Drawing Sheets

Figure 1:
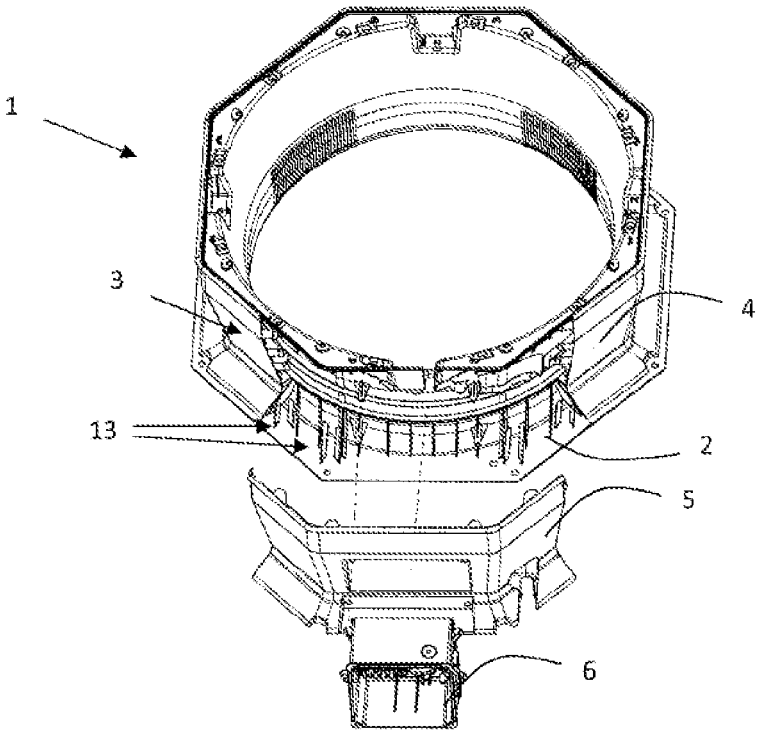

(51) Int. Cl.

| | |
|---|---|
| ***F04D 29/70*** | (2006.01) |
| ***F04D 29/52*** | (2006.01) |
| ***F04D 29/64*** | (2006.01) |

(56) References Cited

U.S. PATENT DOCUMENTS

| | | | | |
|---|---|---|---|---|
| 2012/0051889 | A1* | 3/2012 | Gamissans Bou | F04D 17/06 415/119 |
| 2015/0252818 | A1 | 9/2015 | Heli et al. | |
| 2015/0345509 | A1 | 12/2015 | Best et al. | |

FOREIGN PATENT DOCUMENTS

| | | | | |
|---|---|---|---|---|
| DE | 102012109516 | A1 | 4/2014 | |
| DE | 102012109544 | A1 * | 4/2014 | F04D 19/002 |
| JP | 2000283098 | A | 10/2000 | |

OTHER PUBLICATIONS

Machine Translation of DE202008002350U1 PDF File Name: "DE202008002350U1_Machine_Translation.pdf" (Year: 2009).*
International Search Report (in German with English Translation) for PCT/EP2016/054579, dated Jun. 3, 2016; ISA/EP.

* cited by examiner

MULTIPART HOUSING OF A FAN

CROSS REFERENCE TO RELATED APPLICATIONS

This application is a U.S. National Phase Application under 35 U.S.C. 371 of International Application No. PCT/EP2016/054579 filed on Mar. 3, 2016 and published in German as WO 2016/142276 A1 on Sep. 15, 2016. This application claims priority to German Application No. 10 2015 103 501.4 filed on Mar. 10, 2015. The entire disclosures of all of the above applications are incorporated herein by reference.

The invention concerns a multipart housing of a fan, especially an axial fan with external covering.

Moreover, the invention concerns a fan unit with such a housing.

Various designs of axial fans with housings to accommodate the fan components, such as the impeller or the motor, are known in the prior art. There are also already support elements for fans, forming a kind of housing, such as is disclosed in the patent application DE 10 2012 109 516 A1 of the applicant.

When fans are used in refrigerating and air conditioning, such as in evaporators or refrigerators, strict hygiene requirements must be met. The fans are mounted directly on such appliances and deliver air through evaporators in the standard installed designs. It is thus desirable for the fans working at cold rooms, for example, to become the least soiled possible and to be easy to clean.

Therefore, the problem which the invention proposes to solve is to provide a housing for a fan having slight tendency to become soiled during operation and able to be cleaned easily and with the least possible disassembly.

According to the invention, a multipart fan housing with external covering is proposed, having a housing body to accommodate the fan components, and a radial exterior face of the housing body is surrounded by the external covering in the circumferential direction over its full surface, so that a radial exterior surface of the housing is formed by an exterior surface of the external covering. The external covering is detachably fastened to the housing body. Thanks to such a design of the fan housing, it is possible to clean the external covering independently of the housing body, i.e., the housing body can remain in place with the other fan components at the installed site and only the external covering is removed for cleaning and then put back in place. Furthermore, the use of a separate external covering enables a special configuration of its outer surface, without having to make provision for the design constraints of the housing body. This means that, with the design of the housing body according to the invention, the structural design to accommodate the fan components and enable fastening at the installation site traditionally provided by the entire housing is adopted, but the external covering can be configured primarily in regard to the best possible hygiene and handling flexibility.

In one advantageous embodiment, it is provided that the exterior surface of the external covering is free of undercuts and formed with no pockets or the like, so that the fewest possible dirt particles can cling to it or collect there. The exterior surface of the external covering is smooth and substantially flat.

Moreover, one design variant is advantageous in which the external covering of the housing is formed by a plurality of segments subdivided in the circumferential direction. The segments are advantageously secured detachably to one another and are arranged substantially edge-free with flush transitions between one another along the exterior surface. The securing may be done by hook or clip connections formed on the segments. The plurality of segments enables an easy disassembly of the external covering, access to the radially interior housing body, or also a removal of the electrical connection, which is primarily arranged or designed on one of the segments. Thus, it is possible, in order to remove the external covering, to first dismount the segment with the electrical connection and then the other segment surrounding the housing body. For certain polygonal shapes of the housing, a number of segments corresponding to the number of corners may also be provided, in order to reduce the tool size for the fabrication of the then smaller individual segments. No limits are placed on the design configuration due to the use of the external covering in the form of segments. The fastening of the external covering to the housing body is done preferably by clipping or interlocking.

In another advantageous embodiment making use of a plurality of segments, at least some of the segments are identical in shape, so that they can be fabricated with the same tool.

One variant embodiment of the invention is characterized in that the external covering has an antibacterial coating or antibacterial outer layer on its exterior surface. Nano-noble metals can be used for the antibacterial coating, such as nano-silver. In an alternative sample embodiment, the external covering is surrounded by an antibacterially active outer layer, such as a coated film, which is glued on or shrink-fitted. In a further variant, several coated films are placed one on top of another as a film stack, and designed as pull-off films, so that over the course of the usage films can be removed one at a time. The film lying underneath is then once again hygienically clean.

Besides ease of cleaning, components and connections of the fan must be protected against intense cold effects during refrigeration applications. For this, in one modification of the invention, it is provided that a cavity is formed between the housing body and the external covering, running in the circumferential direction. The cavity forms a chamber which can be utilized to provide a cold shield and a thermal insulation. For example, a heating tape can be placed in the cavity, generating electrically operated heat. Alternatively or additionally, in one embodiment of the invention, thermal insulating material is placed in the cavity. Thus, the fan components can be significantly shielded against the cold action. Moreover, the regularly necessary defrosting process can be speeded up.

The cavity is determined in particular by the spacing between the housing body and the external covering. Its volume corresponds in one especially effective embodiment which is flexible to a filling or a receiving of cables or the like to 2-25%, preferably 5-15%, of an imaginary total volume enclosed by the external covering, i.e., an imaginary closed body formed only by the external covering, whose axial side surfaces are likewise closed.

For better stability and ease of handling during the mounting and dismounting, it is provided in one embodiment that the external covering has stiffening ribs running in the circumferential direction and axially spaced apart. In addition, in one advantageous modification of the invention, the housing body has webs running in the circumferential direction, forming with the stiffening ribs of the external covering a channel running at least for a portion in the circumferential direction. This channel may serve to receive cables or an above-described heating tape and assures a predetermined and fixed position inside the cavity or on the housing body.

The invention also involves the entire fan unit with a motor, an impeller, and optionally a protective cage. The fan unit includes the above-described housing surrounding the impeller.

All features disclosed may be combined in any desired manner, so long as is technically possible.

Figure 2:
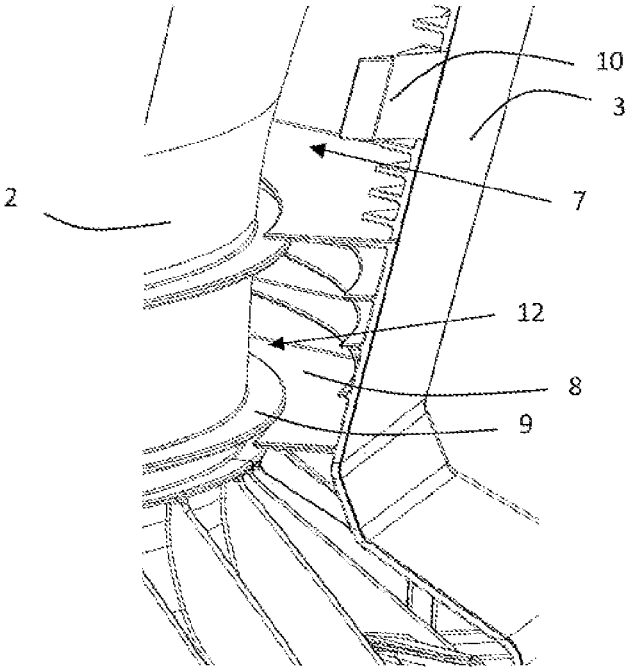
Figure 3:
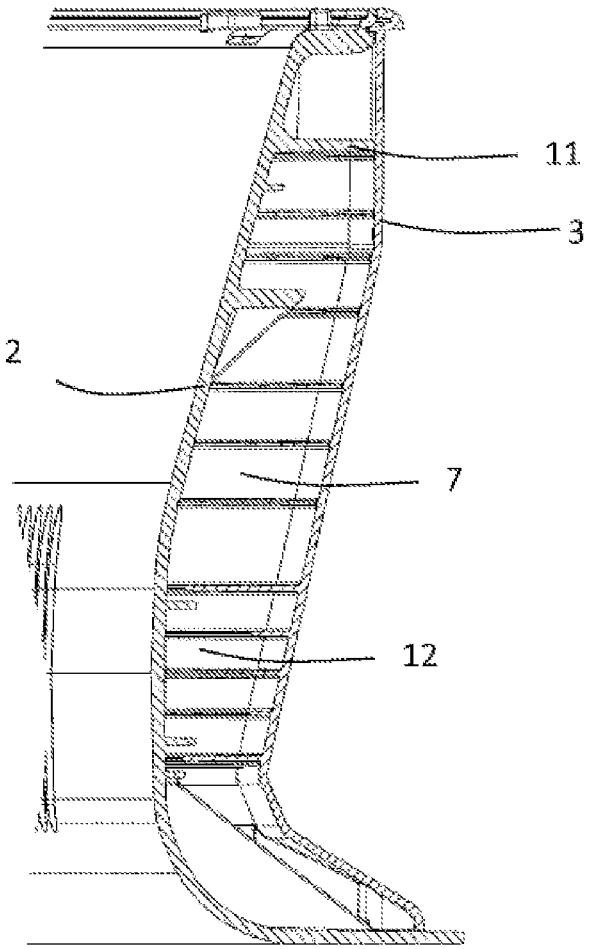

Other advantageous modifications of the invention are characterized in the subclaims or shall be presented below together with the description of the preferred embodiment of the invention with the aid of the figures. There are shown:

FIG. 1 a perspective view of a housing taken apart;

FIG. 2 a side view of the partly taken apart housing of FIG. 1;

FIG. 3 a partially sectioned side view of a margin region of the housing of FIG. 1.

The figures are schematic and exemplary, and serve for a better understanding of the features according to the invention, not all of the features described above being represented, although they could nevertheless be realized, such as the antibacterial coating for example.

FIG. 1 shows an octagonal housing 1, designed as a wall ring, of an axial fan for use in refrigeration applications, in a perspective view and partly taken apart. The housing 1 is formed from a housing body 2, inside which the impeller (not shown) of the fan rotates, and an external covering 3 arranged on the radial exterior face of the housing body 2, surrounding the housing body 2 in the circumferential direction for its full surface. The radial exterior surface of the housing 2 is formed entirely by the exterior surface of the external covering 3. Its contour is smooth, substantially edge-free and formed with no undercuts, so as to offer no possibility of dirt particles clinging to it or collecting there.

In the sample embodiment shown, the external covering 3 is formed by the segments 4, 5, which are fastened together by the hooks 10, shown in greater detail in FIG. 2. The segments 4, 5 in the mounted condition form a flush transition with each other, with no recesses or gaps. FIG. 1 shows for example that the segment 5 with the electrical connection 6 formed on it has been dismounted. The other segment 4 in this embodiment is formed as a single piece, but it may also be divided into multiple parts for a specialized application and to optimize the manufacturing. The external covering 3 or the segments 4, 5 are fastened detachably by clip connections to the housing body 2.

FIGS. 2 and 3 show the housing 1 from FIG. 1 in a side view and a sectional view, each time showing only one side of the blower 1. However, the opposite side is a mirror image of it. The external covering 3 is spaced apart from the housing body 2, so that a cavity 7 is formed between the two components, running entirely in the circumferential direction. The size of the cavity 7 in the embodiment shown is such that its volume determines just 10% of the total imaginary volume enclosed by the external covering 3. For reasons of clarity, the insulating materials arranged in the cavity 7 have been left out of the drawing.

Webs 9, 11 are formed on the housing body 2 running in the circumferential direction and extending radially outward. The web 11 extends in the radial direction as far as the internal surface of the external covering 3 and in this way offers it an end stop as well as a radial bracing. The webs 9 are radially short in configuration, but interact with stiffening ribs 8 formed on the external covering 3 to form a channel 12 running entirely in the circumferential direction, in which cables or a heating tape can be laid in fixed position. The number and thickness of the stiffening ribs 8 is adapted to the size and material thickness of the external covering 3. As can be seen from FIG. 1, a guide 13 with starting bevels is also provided on the housing body 2 in order to allow the external covering 3 to be mounted on the housing body 2 in a defined and replicable position-fixed manner.

The invention is not limited in its embodiment to the preferred sample embodiments given above. Instead, a number of variants are conceivable, making use of the presented solution even with fundamentally different configurations. For example, besides the channel formed in the cavity, further means can be arranged for the fastening of fan components, which are then not visible from the outside in the installed condition. Furthermore, the choice of material for the external covering is primarily selected as an insulator, plastic being especially preferred.

The invention claimed is:

1. A housing of a fan with external covering, the housing comprises a housing body to accommodate fan components, the housing body defining a wall with a top end and a bottom end, the housing body has a polygonal shape, and a radial exterior face of the housing body is surrounded from the top end to the bottom end by the external covering in a circumferential direction over its full surface, so that a radial exterior surface of the housing is formed by an exterior surface of the external covering, and the external covering is detachably attachable to the housing body and the external covering is formed from a plurality of segments that are subdivided in the circumferential direction;

the housing body has webs running in the circumferential direction, forming with stiffening ribs of the external covering a channel running at least for a portion in the circumferential direction;

at least one of the webs extend in the radial direction as far as an internal surface of the external covering and forms a radial bracing and/or a guide for the external covering in a mounted position; and at least one of the webs is radially shorter than at least one of the other webs, and said at least one radially shorter web interacts with at least one of said stiffening ribs formed on the external covering to form the channel running entirely in the circumferential direction.

2. The housing of a fan as claimed in claim 1, wherein the segments are detachably attached to one another and are arranged substantially edge-free with flush transitions between one another along the exterior surface of the external covering.

3. The housing of a fan as claimed in claim 1, wherein at least one of the plurality of segments is detachably secured to the housing body, and at least one segment is detachable from and reattachable to the rest of the segments and the housing body.

4. The housing of a fan as claimed in claim 1, wherein the exterior surface of the external covering is formed free of undercuts.

5. The housing of a fan as claimed in claim 1, wherein a cavity is formed between the housing body and the external covering, running in the circumferential direction.

6. The housing of a fan as claimed in claim 5, wherein the cavity is determined by a spacing between the housing body and the external covering a volume of the cavity determines 2-25% of an arbitrary selected total volume enclosed by the external covering.

7. The housing of a fan as claimed in claim 5, wherein the cavity is at least partly filled with thermal insulating material.

8. The housing of a fan as claimed in claim 1, wherein the external covering has an antibacterial coating or antibacterial outer layer on its exterior surface.

9. The housing of a fan as claimed in claim 1, wherein the housing body and/or the external covering is formed from insulating material.

10. A fan unit with a motor and an impeller, comprising a housing as claimed in claim 1, wherein the housing surrounds the impeller.

* * * * *